United States Patent [19]

Chen

[11] Patent Number: 4,847,913

[45] Date of Patent: Jul. 18, 1989

[54] BASEBALL CHEST PROTECTOR

[76] Inventor: Chien F. Chen, 17, Kung 6 Road, Linkou 2nd Industrial Park, Taipei Hsien, Taiwan

[21] Appl. No.: 110,306

[22] Filed: Oct. 20, 1987

[51] Int. Cl.[4] ..... A41D 1/00; A41D 13/00

[52] U.S. Cl. ..... 2/2; 2/92; 2/2.5

[58] Field of Search ..... 2/2, 2.5, 92, 96

[56] References Cited

U.S. PATENT DOCUMENTS

| | | | |
|---|---|---|---|
| 2,468,841 | 5/1949 | Siegel | 2/2 |
| 2,796,208 | 6/1957 | O'Leary et al. | 2/2 X |
| 2,990,549 | 7/1961 | Doughty | 2/2 |
| 3,076,197 | 2/1963 | Glahe | 2/2 |
| 3,125,762 | 3/1964 | Glahe | 2/2 |
| 3,574,861 | 4/1971 | Hale | 2/2 |
| 3,803,639 | 4/1974 | Cohen | 2/2.5 |
| 4,525,875 | 7/1985 | Tomczak | 2/2 |

FOREIGN PATENT DOCUMENTS

| | | | |
|---|---|---|---|
| 959638 | 3/1950 | France | 2/92 |

*Primary Examiner*—Werner H. Schroeder
*Assistant Examiner*—Jeanette E. Chapman
*Attorney, Agent, or Firm*—Diller, Ramik & Wight

[57] ABSTRACT

A chest protector formed by a pair of chest protector bodies; each of the chest protector bodies being formed to include a one-piece, homogeneous, in situ molded foamed polymeric/copolymeric material; a zipper disposed along a vertical line of the chest protector for securing the chest protector bodies to each other, and straps for securing the chest protector bodies to each other across the back of a user.

3 Claims, 2 Drawing Sheets

BASEBALL CHEST PROTECTOR

BACKGROUND OF THE INVENTION

The invention is directed to a chest protector of the type used by catchers and umpires in baseball games in order to protect the wearer from being injured by the force impact from a baseball as might normally occur when the baseball is "foul-tipped" by a batter. Such "foul-tips" most often strike the catcher or umpire, and obviously, chest protectors have been used in the past to reduce/eliminate such damage.

Conventional baseball chest protectors are traditionally manufactured by placing small pieces of foam between front and back pieces of fabric, sometimes gluing the foam in place, and generally stitching the pieces of fabric to each other along the peripheral border, in voids between the pieces of foam, and sometimes through the foam. Some chest protectors utilize cotton which is simply pushed into ribs or chambers of fabric and appropriately stitched. The process of manufacturing such conventional chest protectors is labor intensive and time consuming and the protection afforded thereby is nominal at best.

Such traditional or conventional chest protectors also cannot diffuse the force of impact created by the forceful contact of a high-speed baseball, particularly with respect to such conventional chest protectors which include a plurality of spaced or separated ribs. The spacing between the ribs obviously offer no protection to the wearer of such conventional rib chest protectors.

Conventional chest protectors are also formed as a single unit, though made of a plurality of pieces, and are difficult, and inconvenient to transport, pack and wear. More importantly, it is difficult to place the chest protectors upon the user's body and remove the same therefrom because of the various rings, hook and like clasps which are required for attachment, detachment and/or adjustment. Furthermore, these hooks, buckles and clasps are normally necessarily placed in the lower front portion of conventional chest protectors and when struck by a baseball actually do considerable damage since they intensify the impact area of the baseball because of the hard nature of the material from which they are constructed (metal) and the abrupt/-sharp edges thereof.

SUMMARY OF THE INVENTION

In keeping with the foregoing, a parimary object of the present invention is to provide a novel two-piece chest protector, each piece thereof being a molded in situ homogenous polyurethane foam member precasted in a metal mold which when foamed through heat and pressure results in a relatively thick, dense, uniform body of highly impact resistant and shock absorbent material which readily protects the user.

The two-piece chest protector is also preferably provided with a vertical zipper disposed along the vertical front so that the two pieces of the chest protector can be rapidly placed upon the body of the user or removed therefrom by quickly zipping or unzipping the associated zipper.

By constructing the chest protector from two pieces with a vertical zipper, the chest protector can also be pre-adjusted before being placed upon the body of the wearer and, equally importantly, conventional metallic hooks, buckles or clasps are unnecessary anywhere in the front region, lower front region, or lower side regions of the chest protector thus assuring that impact forces from delivered baseballs are not intensified when the chest protector is struck thereby.

With the above, and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
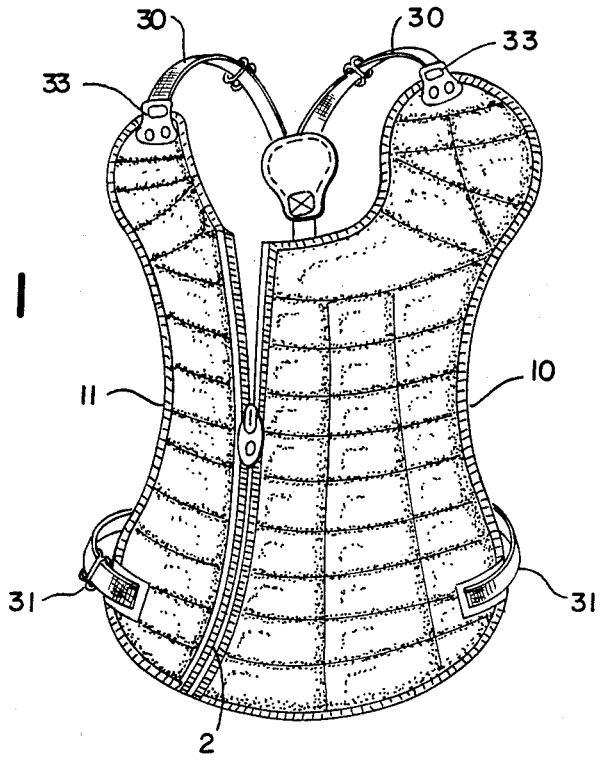
FIG. 1 is a front perspective view of the novel chest protector of this invention and illustrates two halves or portions thereof united by a vertical zipper.

A novel chest protector constructed in accordance with this invention is generally designated by the reference numeral 10 and includes two chest protector body portion halves or parts 11, 12.

Figure 2:
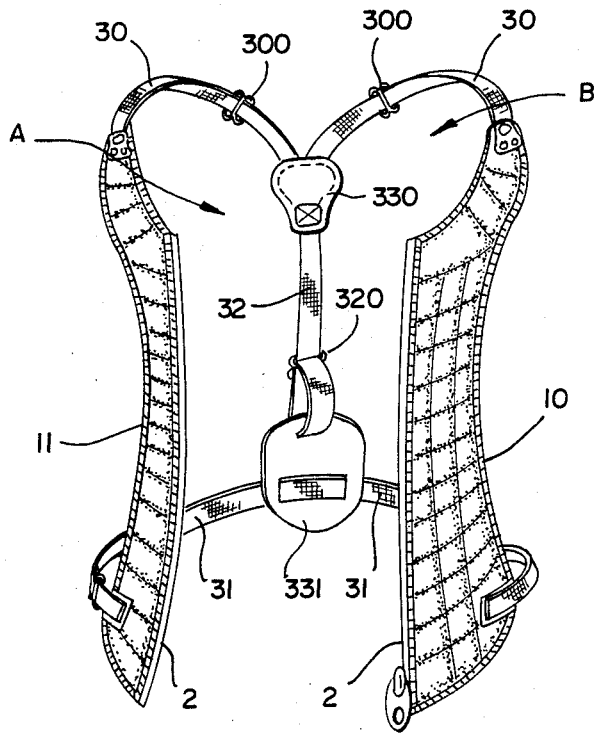
FIG. 2 is a front perspective view of the novel chest protector of this invention and illustrates the unzipped condition of the zipper and the adjustable shoulder belts, a back belt and a waist belt associated therewith.
Figure 3A:
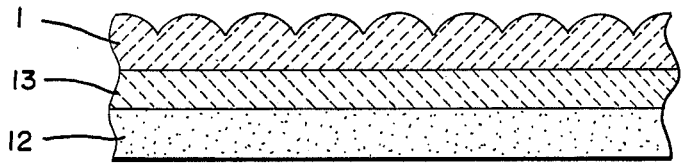
FIG. 3A is an enlarged cross sectional view taken through a single layer chest protector constructed in accordance wtih this invention, and illustrates polyurethane foam forming the body thereof.

The chest protector parts 11, 12 are generally identical though mirror-images of each other and each is formed from a single piece of polyurethane foam (FIG. 3A which is molded in situ in a metallic mold under heat and pressure to form a one-piece homogeneous body 11, 12 which may, if desired, to contoured, fluted, etc. as is generally designated in FIGS. 1 and 2 and the upper portion of FIG. 3A). The fluted configuration imparts a "sewn" appearance to the chest portector 10 as is most apparent from FIG. 1, yet the overall shock resistant nature of the body is undiminished, as in conventionally sewn/ribbed chest protectors.

The chest protector bodies 11, 12 carry zipper 2 disposed generally along a vertically, as is clearly apparent from FIGS. 1 and 2. The zipper 2 can be used to open and close the chest protector bodies 11, 12, as illustrated in FIGS, 2 and 1, respectively, and the zipper 2 is the only element requiring manipulation to place the chest protector 10 operative upon the body of the user and remove the same therefrom.

The chest protector bodies 11, 12 are joined to each other by a pair of shoulder belts or straps 30. The waist belt passes through slots(unnumbered) of a leather or like material connector pad 331 and opposite ends (unnumbered) of the waist belt or strap 31 is sewed to lower portions of the chest protector bodies 11, 12 in the absence of any hook, buckle or light metallic implement. Preferably, the waist belt or strap 31 is constructed from elastic material and need not be adjusted in any fashion whatever for virtually any user. However, should adjustment be necessary, the single waist belt or strap 31 can have appropriate adjustment means provided in the form of adjusting clamps, loops, buckles or the like, but these would be at the rear side of the chest protector 10 generally in the area of the connector pad 331.

The should belts 30 and the back belt 32 are also connected to a pad 330 by appropriate stitching. A conventional fastening element 33 connects each of the shoulder belts 30 to the front of the upper portions (unnumbered) of the respective chest protector bodies 11, 12. Preferably nonmetallic adjusting clasps/loops 300 permit the shoulder belts 30 to be adjusted in a conventional manner. The pad 330 is connected by stitching to a back belt 32 which is looped through a slot (unnumbered) of a connector pad 331 having slots (unnumbered) which slidably receive the waist belt or strap 31. The back belt 32 is connected to itself by a nonmetallic adjusting loop 320.

A wearer can, of course, preadjust the adjusting mechanisms 300, 320, and once having been adjusted they need not be adjusted for the particular user thereafter. Once these adjustments are made the chest protector 10 can be worn or removed by zipping and unzipping the zipper 2. Accordingly, the chest protector offers ultimate protection against impact from high velocity baseballs, such as foul-tipped baseballs, and precludes aggravated damage by the elimination of all metallic hooks, buckles and/or clasps utilized by conventional chest protectors at front, forward lower portions of such chest protectors. Obviously, the zipper 2 is preferably constructed from plastic material and is of such a limited area that baseballs striking in the vicinity thereof have impact energy absorbed with virtually the same efficiency as anywhere else throughout the entire chest protector bodies 11, 12. Furthermore, since all adjusting devices are nonmetallic and are to the rearside of the chest protector 10, damage cannot occur therethrough.

Figure 3B:
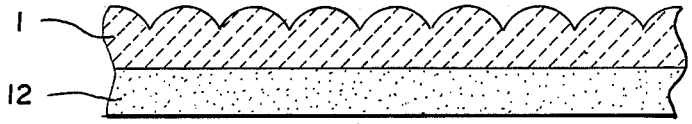
FIG. 3B is a cross sectional view through a two layer chest protector of the invention, and illustrates two layers of polyurethane foam, and upper or outer layer being heat/pressure molded polyurethane foam and a lower/inner layer being a piece of polyurethane foam which has not been heat/pressure molded with the layers being adhesively bonded/laminated together.

Reference is now made to FIG. 3B of the drawgings in which the chest protector bodies 11, 12 are shown as being formed from two layers 1, 2 of polymeric/-copolymeric material. The layer 1 corresponds identically to the layer 1 of FIG. 3A and is formed from polyurethane foam molded under heat and pressure and appropriately contoured, if desired. The layer 1 functions as the front or forward, facing surface of the overall chest protector 10. A layer 12 which is laminated or easily bonded to the layer 1 is also polyurethane foam but is not molded under heat and pressure, it is simply adhered or laminated to the layer 1 and functions as the rear of inside-facing portion of the overall chest protector 10.

Figure 3C:
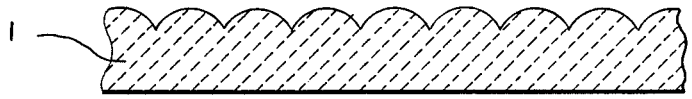
FIG. 3C is a cross sectional view of a three layer chest protector, and illustrates upper/outer and lower-/inner layers identical to these illustrated in FIG.3B with a layer of polyethylene foamed material laminated-/adhesively bonded therebetween.

Referring to FIG. 3C of the drawings, the layers 1, 12 correspond to the layers 1, 12 of FIG. 3B and interspersed or sandwiched therebetween in another layer 13 of polyethylene foam. However, the polyethylene foam 13 is not foamed under heat and pressure but is initially formed as a polyethylene foam sheet, cut to size, and laminated/adhesively bonded between the layers 1, 12.

Although a preferred embodiment of the invention has been specifically illustrated and described herein, it is to be understood that minor variations may be made in the apparatus without departing from the spirit and scope of the invention, as defined in the appended claims.

I claim:

1. A chest protector comprising a pair of chest protector bodies; each of said chest protector bodies being formed of a three-ply laminate including an in situ molded outermost ply remote from the body of a wearer, an innermost ply immediately adjacent the body of a wearer and a medial ply therebetween; said outermost ply being formed of polyurethane foamed under heat and pressure and having a contoured outer surface and a predetermined peripheral profile; said innermost ply being foamed polyurethane, said medial ply being polyethylene foam, said innermost and medial plies being peripherally cut to said predetermined peripheral profile and laminated to each other and to said outermost ply, strap means for securing said chest protector bodies to each other across the back of a user, and zipper means disposed along a vertical line of said chest protector for releasably securing said chest protector bodies to each other along said vertical line.

2. A chest protector comprising a pair of chest protector bodies; each of said chest protector bodies being formed of a two-ply laminate including an in situ molded outermost ply remote from the body of a wearer and an innermost ply immediately adjacent the body of a wearer; said outermost ply being formed of polyurethane foamed under heat and pressure and having a contoured outer surface and a predetermined peripheral profile; said innermost ply being foamed polyurethane, said innermost ply being peripherally cut to said predetermined peripheral profile and laminated to said outermost ply, strap means for securing said chest protector bodies to each other across the back of a user, and zipper means disposed along a vertical line of said chest protector for releasably securing said chest protector bodies to each other along said vertical line.

3. A chest protector comprising a pair of chest protector bodies; each of said chest protector bodies consisting of a single-ply of polyurethane foamed in situ under heat and pressure and having a contoured outer surface and a predetermined peripheral profile; strap means for securing said chest protector bodies to each other across the back of a user, and zipper means disposed along adjacent front peripheral edges of said chest protector bodies defining a generally vertical line of said chest protector for releaseably securing said chest protector bodies to each other along said vertical line.

* * * * *